US006383312B1

(12) United States Patent
Konter et al.

(10) Patent No.: US 6,383,312 B1
(45) Date of Patent: May 7, 2002

(54) NICKEL BASE ALLOY

(75) Inventors: Maxim Konter, Klingnau; Peter David Holmes, Winkel; Christoph Tonnes, Klingnau, all of (CH); Hans-Peter Bossmann, Wiesloch; Christoph Sommer, Plankstadt, both of (DE)

(73) Assignee: Alstom Ltd, Baden (CH)

( * ) Notice: Subject to any disclaimer, the term of this patent is extended or adjusted under 35 U.S.C. 154(b) by 0 days.

(21) Appl. No.: 09/530,421

(22) PCT Filed: Oct. 30, 1997

(86) PCT No.: PCT/EP97/05999

§ 371 Date: Jul. 24, 2000

§ 102(e) Date: Jul. 24, 2000

(87) PCT Pub. No.: WO99/23265

PCT Pub. Date: May 14, 1999

(51) Int. Cl.[7] ..... C22C 19/05; C23C 4/08; C23C 30/00

(52) U.S. Cl. ..... 148/410; 420/448

(58) Field of Search ..... 420/445, 446, 420/447, 448; 148/410

(56) References Cited

U.S. PATENT DOCUMENTS 4,719,080 A * 1/1988 Duhl et al. ..... 420/443
4,727,740 A * 3/1988 Yabuki et al. ..... 72/209
4,844,864 A * 7/1989 Frank ..... 420/447
4,853,044 A * 8/1989 Ford et al. ..... 148/3
5,043,138 A 8/1991 Darolia et al. ..... 420/443
5,240,491 A 8/1993 Budinger et al. ..... 75/255
5,294,239 A * 3/1994 Zoltzer et al. ..... 75/237
5,316,866 A * 5/1994 Goldman et al. ..... 428/621
5,370,497 A * 12/1994 Doi et al. ..... 415/199.5
5,622,638 A 4/1997 Schell et al. ..... 219/121.64

FOREIGN PATENT DOCUMENTS

EP 0412397 A1 2/1991

* cited by examiner

*Primary Examiner*—Roy King
*Assistant Examiner*—Harry S. Wilkins, III
(74) *Attorney, Agent, or Firm*—Burns, Doane, Swecker & Mathis, L.L.P.

(57) ABSTRACT

A nickel base alloy comprising: (measured in % by weight): 11–16% Co; 12.2–15.5% Cr; 6.5–7.2% Al; 3.2–5.0% Re; 1.0–2.5% Si; 1.5–4.5% Ta; 0.2–2.0% Nb; 0.2–1.2% Hf; 0.2–1.2% Y; 0–1.5% Mg; 0–1.5% Zr; 0–0.5% La and La series elements; 0–0.15% C; 0–0.1% B; and a remainder including Ni and impurities. The alloy is particularly suited for coatings for gas turbine components such as gas turbine blades and vanes.

12 Claims, 4 Drawing Sheets

NICKEL BASE ALLOY

TECHNICAL FIELD

The invention relates to a nickel base alloy.

BACKGROUND OF THE INVENTION

This invention relates to nickel-based alloys, especially for those used as a coating for high temperature gas turbine blades and vanes.

Wide use of single crystal (SX) and directionally solidified (DS) components has allowed increased turbine inlet temperature and therefore turbine efficiency. Alloys, specially designed for SX/DS casting, were developed in order to make a maximum use of material strength and temperature capability. For this purpose modem SX alloys contain Ni and solid-solution strengtheners such as Re, W, Mo, Co, Cr as well as γ'-forming elements Al, Ta, Ti. The amount of refractory elements in the matrix has continuously increased with increase in the required metal temperature. In a typical SX alloys their content is limited by precipitation of deleterious Re-, W-or Cr-rich phases.

High temperature components are typically coated to protect them from oxidation and corrosion. In order to take full advantage of increased temperature capability and mechanical properties of SX/DS blade base material, coating material must provide now not only protection from oxidation and corrosion, but must also not degrade mechanical properties of base material and have a stable bond to substrate without spallation during the service. Therefore requirements for advance coatings are:

- high oxidation and corrosion resistance, superior to those of the SX/DS superalloys;
- low interdiffusion of Al and Cr into the substrate to prevent precipitation of needle-like phases under the coating;
- creep resistance comparable to those of conventional superalloys, which can be achieved only with the similar coherent γ-γ' structure;
- low ductile-brittle transition temperature, ductility at low temperature;
- thermal expansion similar to substrate along the whole temperature range.

The coating described in U.S. Pat. No. 5,043,138 is a derivative of the typical SX superalloy with additions of yttrium and silicon in order to increase oxidation resistance. Such coatings have very high creep resistance, low ductile-brittle transition temperatures (DBTT), thermal expansion coefficients equal to those of the substrate and almost no interdiffusion between coating and substrate. However, the presence of such strengtheners as W and Mo, as well as a low chromium and cobalt content typical for the SX superalloys, has a deleterious effect on oxidation resistance. European Patent Publication 0 412 397 A1 describes a coating with significant additions of Re, which simultaneously improves creep and oxidation resistance at high temperature. However, the combination of Re with a high Cr content, typical for traditional coatings, results in an undesirable phase structure of the coating and interdiffusion layer. At intermediate temperatures (below 950–900° C.), the α-Cr phase is more stable in the coating than the γ-matrix. This results in a lower thermal expansion compared to the base material, a lower toughness and possibly a lower ductility. In addition, a significant excess of Cr in the coating compared to the substrate results in diffusion of Cr to the base alloy, which makes it prone to precipitation of needle like Cr-, W- and Re-rich phases.

SUMMARY OF THE INVENTION

Accordingly, one object of the invention is to provide an nickel base alloy which is designed to combine an improved ductility and creep resistance, phase stability of coating and substrate during service, phase structure and thermal expansion similar to the substrate and an excellent oxidation resistance.

The invention provides a nickel base alloy, particularly useful as a coating, which comprises: (measured in % by weight):

| | |
|---|---|
| Co | 11–16 |
| Cr | 12.2–15.5 |
| Al | 6.5–7.2 |
| Re | 3.2–5.0 |
| Si | 1.0–2.5 |
| Ta | 1.5–4.5 |
| Nb | 0.2–2.0 |
| Hf | 0.2–1.2 |
| Y | 0.2–1.2 |
| Mg | 0–1.5 |
| Zr | 0–1.5 |
| La and La-series elements | 0–0.5 |
| C | 0–0.15 |
| B | 0–0.1 |

a remainder including Ni and impurities

The advantages of the invention can be seen, inter alia, in the fact that by optimisation of Al activity in the alloy and due to the-specific phase structure, consisting of fine precipitates of γ' and α-Cr in γ-matrix an improved ductility and creep resistance, phase stability of coating and substrate during service, phase structure and thermal expansion similar to the substrate and an excellent oxidation resistance can be obtained. To achieve the γ-γ'-α-Cr-structure the relatively high but limited contents of Al and Cr were combined. To prevent coarsening of the α-Cr phase an addition of more than 3% Re was necessary.

BRIEF DESCRIPTION OF THE DRAWINGS

A more complete appreciation of the invention and the attendant advantages thereof will be readily obtained by reference to the accompanying drawings, wherein.

DESCRIPTION OF THE PREFERRED EMBODIMENTS

The invention describes a nickel base superalloy, whose essential composition range is shown in Table 2, which is particularly adapted for use as a coating for advanced gas turbines blades and vanes. Generally, Table 1 shows the alloys as used during the experiments. From the experimental coatings only LSV 3 is an alloy which has a composition according to the invention. Preferably, the alloy could be produced by the vacuum melt process in which powder particles are formed by inert gas atomisation. The powder can then be deposited on a substrate using, for example, thermal spray methods. However, other methods of application may also be used. Heat treatment of the coating using appropriate times and temperatures is recommended to achieve a good bond to the substrate and a high sintered density of the coating. The alloy chemical composition is specifically designed to combine an improved ductility and creep resistance, phase stability of the coating and substrate during service, phase structure and thermal expansion similar to the substrate and an excellent oxidation resistance due to high activity of Al. This is achieved by optimisation of Al activity in the alloy (FIGS. 1–4) and due to the specific phase structure, consisting of fine precipitates of γ' (55–65 vol.%) and α-Cr (1.5–3 vol.%) in γ-matrix (alloys LSV 1,3, FIG. 5). To achieve this structure the relatively high contents of Al (about 7%) and Cr (about 13%) were combined. To prevent coarsening of the α-Cr phase an addition of more than 3% Re was necessary. The composition of experimental coatings are shown in Table 1. Table 3 represents results of experimental evaluation of several compositions of coatings with respect of their oxidation resistance and mechanical properties. Upon oxidation the alloy shows an increase in weight due to the uptake of oxygen. If the growing oxide scale is protective the weight gain as a function of oxidation time follows a parabolic rate law. Obviously, a small weight increase is indicative of a slowly growing oxide scale and, thus, is a desirable property. Presented in Table 3 are experimental data which show that the weight change is lowest for the preferred alloy composition (LSV 1,3) when compared to experimental alloys LSV 4,5,7,10,11. The oxidation resistance of the inventive alloy is determined by Al content (as reservoir of Al atoms for formation of protective $Al_2O_3$ scale) by activity of Al in the system, by alloy phase structure, which determines Al diffusion and by control over oxide growth rate through controlled addition of active elements, i.e combination of Ta and Nb. Presence and content of other elements has a very strong effect on the activity of Al. Examples modelled for γ-γ'-α-Cr system using known computer software (ThermoCalc and DICTRA), are presented on FIGS. 1–4 (for varied Al, Cr, Si and Re respectively with fixed content of other elements, reference system Ni-13 Cr-12 Co-7 Al-3.5 Re-2 Si-3 Ta-1 Nb).

Figure 1:
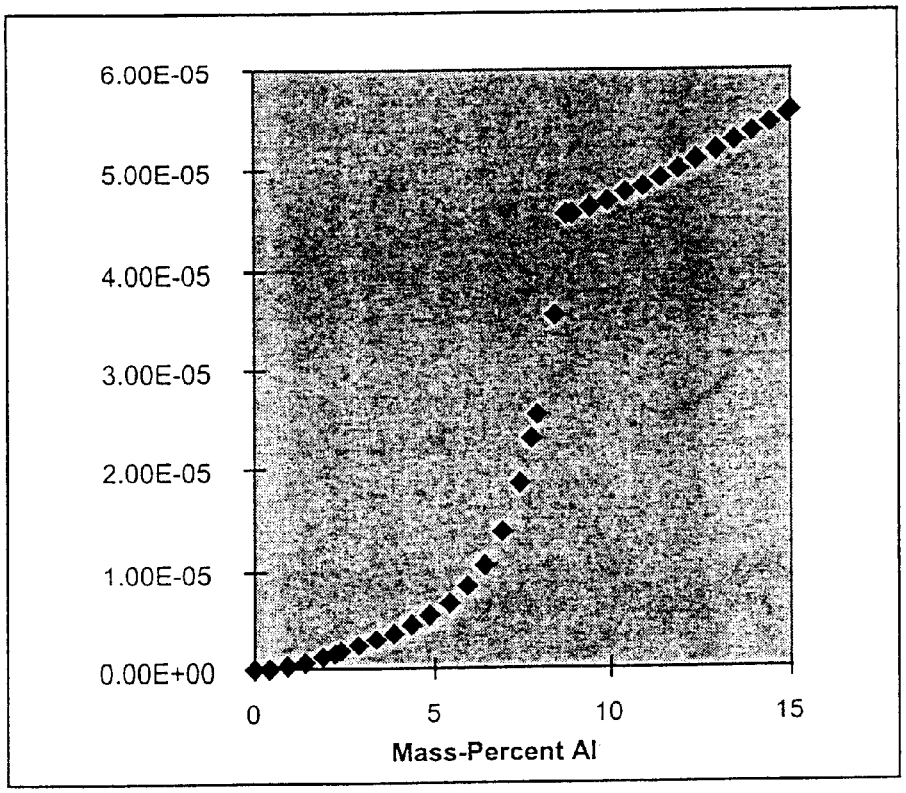
FIG. 1 shows Al activity vs. Al content in a γ-γ'-α-Cr system.

FIG. 1 shows, that for the Al content higher than 6.5%, activity of Al (and therefore the oxidation resistance of the alloy) increases most efficiently. This is illustrated by comparison of properties of alloys LSV-1 and LSV-10 (Table 3). Their chemical composition is identical with exception of the Al level (7% and 6.1% respectively).

Figure 6:
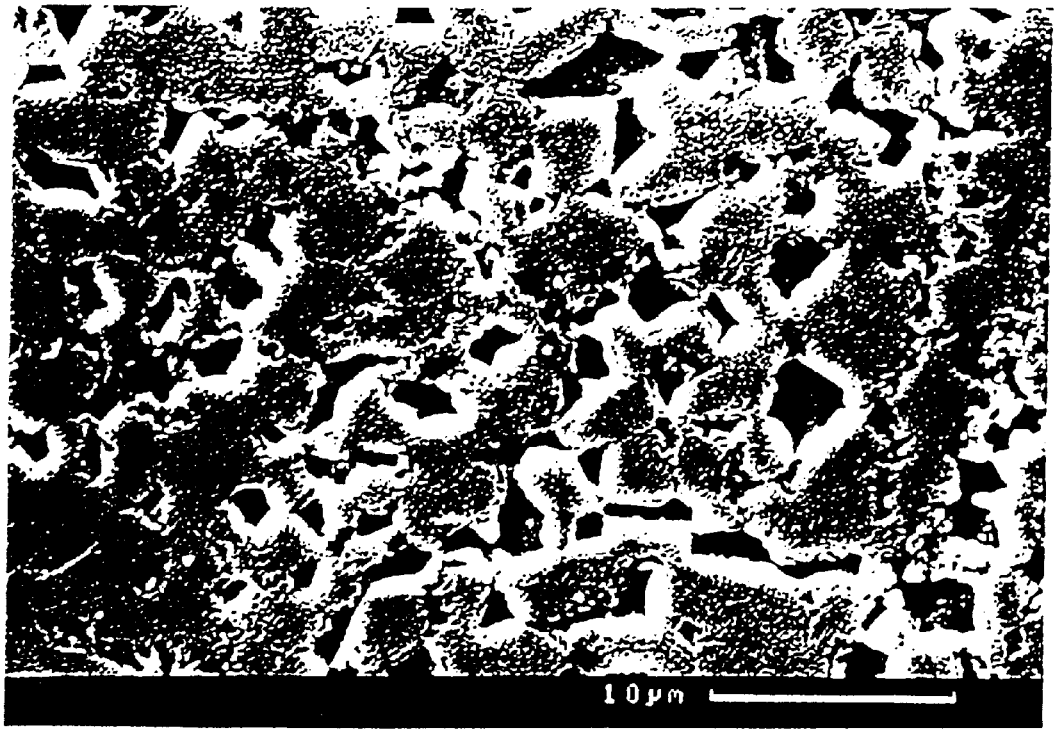
FIG. 6 shows the phase structure of the LSV-6 coating with undesirable chain-like distributions of β-(black) and σ-(gray) phases.

If Al content exceeds some particular level (7.2% in the present system), the precipitation of β-and σ-phases with undesirable morphology reduces the low temperature ductility of alloys (alloy LSV-6, FIG. 6, Table 3,4).

Figure 2:
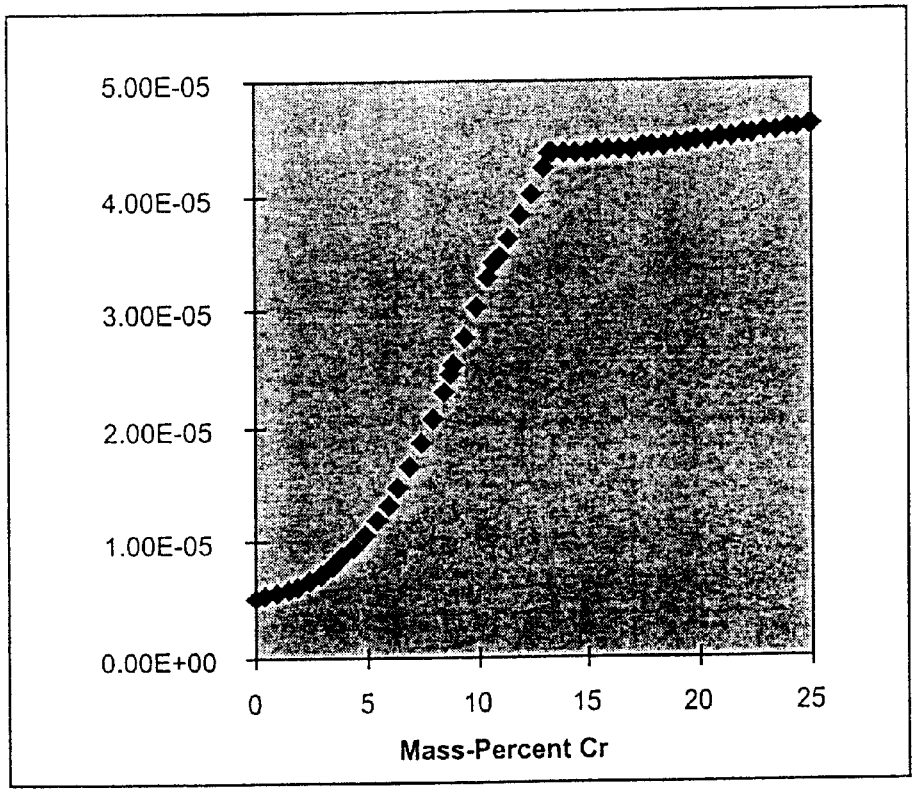
FIG. 2 shows Al activity vs. Cr content in a γ-γ'-α-Cr system.
Figure 3:
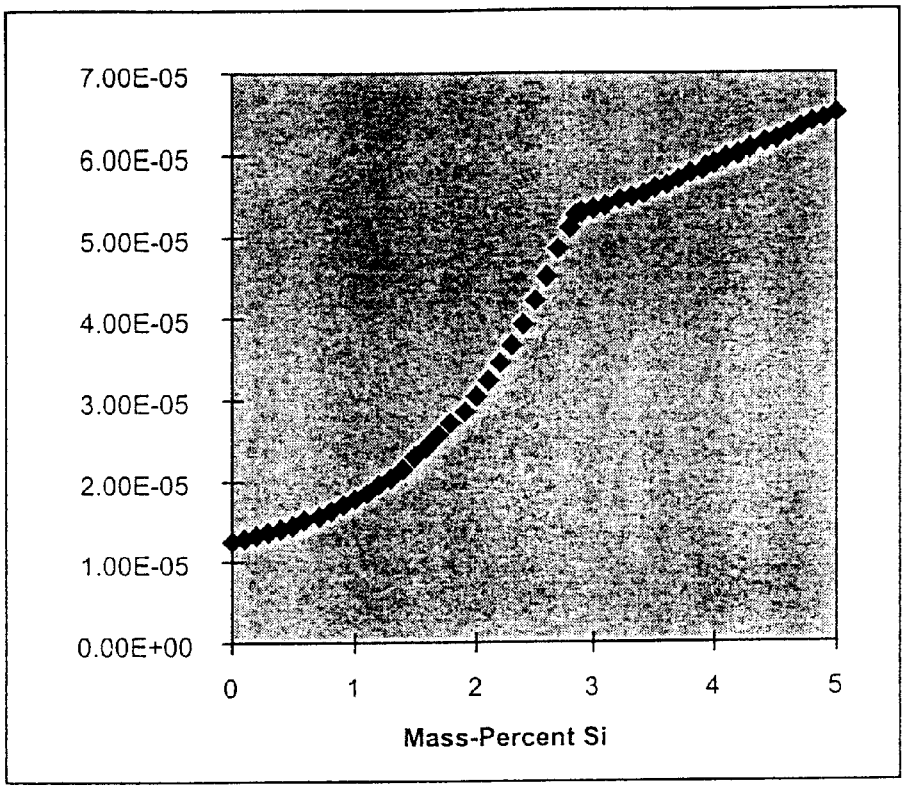
FIG. 3 shows Al activity vs. Si content in a γ-γ'-α-Cr system.

Very tight control is also required for the Cr content. The low Cr content results not only in low corrosion resistance of the coating, but also in lower activity of Al and therefore considerably lower oxidation resistance. This is illustrated in FIG. 2, which shows, that the highest activity of Al in the alloy can be achieved at Cr contents higher than 12%. Below this level the $Al_2O_3$ scale is not dense and additional Ni and Cr oxides reduces the oxidation resistance. Comparison of properties of alloys LSV 1, 3 and alloy LSV-11 from Table 3 shows this effect on the other hand, Cr contents higher then 15.5%, result in significant reductions in low temperature ductility of the alloy (alloy LSV-9, Table 1,3,4). At this concentration of Cr and other elements, the more thermodynamically stable at intermediate (below 900° C.) temperatures α-Cr phase replaces to a large extent the ductile γ-matrix during the service exposure, which results in considerable enbrittlement of the coating. Resulting α-Cr-σ-γ'-γ or α-Cr-β-γ'-γ structures are much less ductile than the γ-γ' structure with fine α-Cr precipitates chosen for the coatings of the present invention.

Co increases the solubility of Al in the γ-matrix. The relatively high Co level in alloys of the present invention allows the achievement of uniquely high concentrations of both Al and Cr in the γ-matrix without precipitation of the aforementioned undesirable β- and σ- phases, and therefore allows for increased oxidation resistance of the alloy without a reduction in mechanical properties. A comparison of the properties of LSV-1 and LSV-3 with those of the alloy LSV-4, which is similar to the compositions of U.S. Pat. No. 5,035,958, confirms the beneficial role of a high Co content (Table 3). A high level of Co (more than 16%) results in a significant lowering of the γ'-solvus temperature compared to the base alloy. Therefore, at temperatures above the coating γ'-solvus and below the substrate γ'-solvus, the two materials have a high thermal expansion mismatch which leads to a significant reduction in the coating thermomechanical-fatigue-(TMF)-life.

Figure 4:
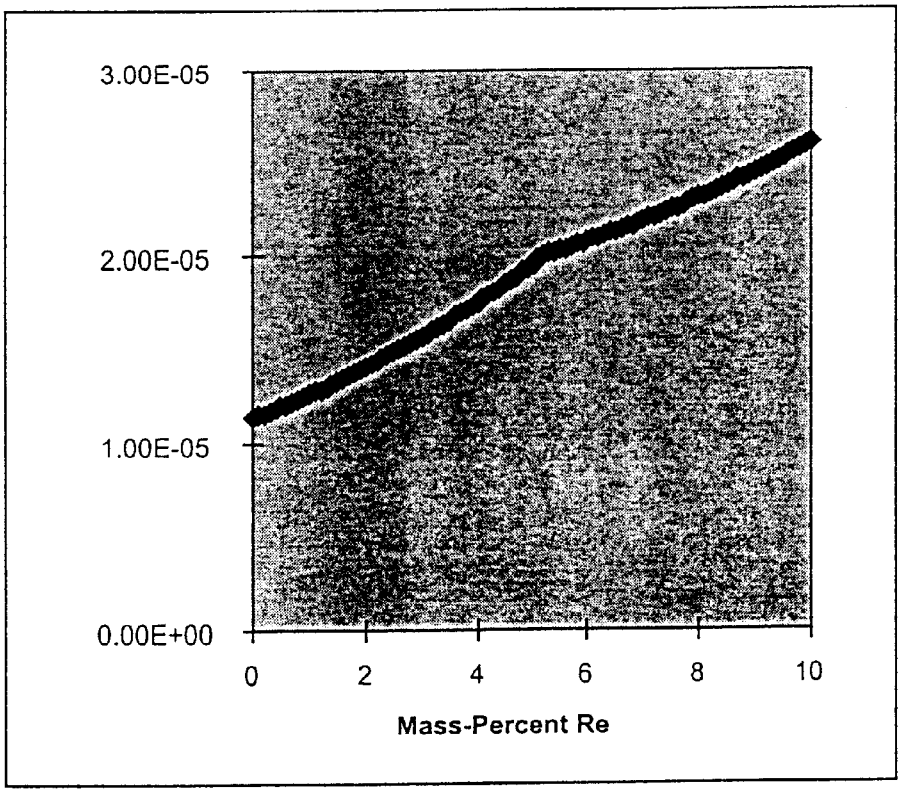
FIG. 4 shows Al activity vs. Re content in a γ-γ'-α-Cr system.
Figure 5:
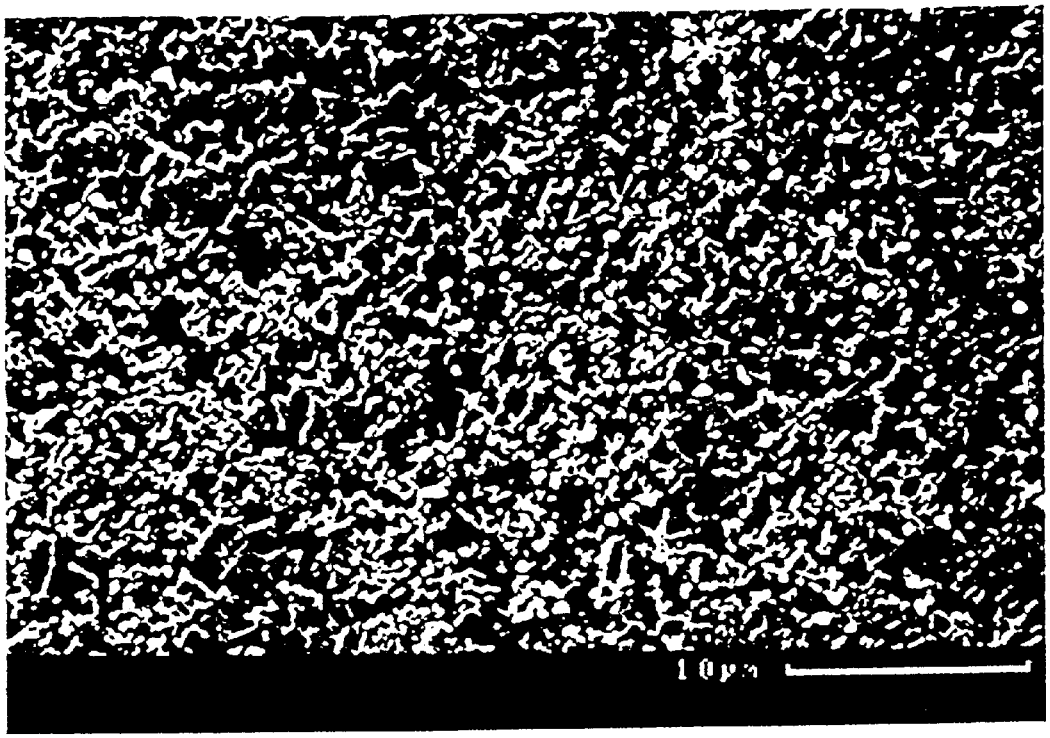
FIG. 5 shows the phase structure of the LSV-1 coating with fine precipitates of α-Cr, Re phase which is white due to high Re content and edge effect.
Figure 7:
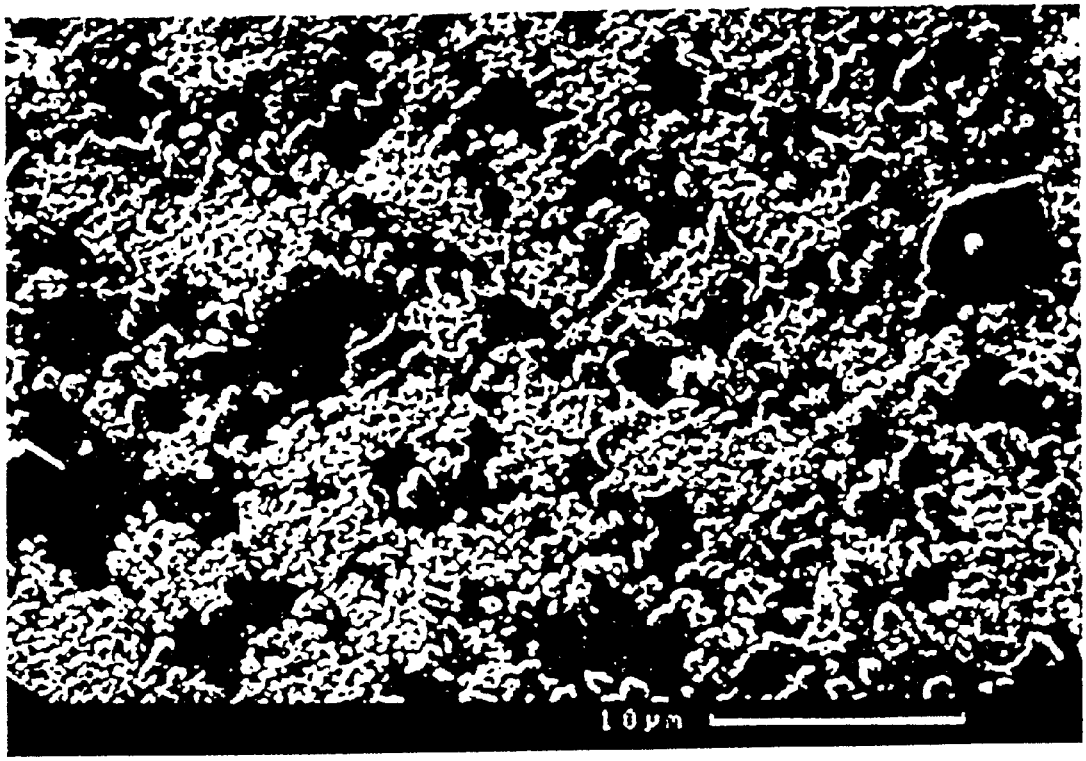
FIG. 7 shows the phase structure of the LSV-5 coating with coarse pentagonal precipitates of α-Cr phase.

Re in the alloy replaces other refractory elements such as W and Mo and provides high creep and fatigue resistance to the coating without deleterious effect on oxidation and corrosion resistance. Moreover, Re increases the activity of Al in the alloy and therefore is beneficial for oxidation resistance (FIG. 4). At same time Re is responsible for stabilising the fine morphology of γ' particles which also considerably improves creep properties. These functions of Re are relatively linear to its content in the alloy and are known from the art. What was found new in the present invention, is that in the γ-γ'-α structure Re considerably changes α-Cr composition and morphology, but only after some particular level in the alloy. At contents up to 3%, Re partitioning occurs mostly in the γ-matrix, similar to it's behaviour in superalloys. The α-Cr phase at low Re concentrations consists of 95 at. % of Cr with 1–2 at.% of each Ni, Re, Co. The α-Cr precipitates have coarse pentagonal morphology with sizes on the order of 3–6 μm (as in alloy LSV-5, FIG. 7). The excess of Re and Cr in the matrix precipitates separately in the undesirable form of needle-like Re-rich TCP phases (so called r- and p-phases), especially at the interface with the substrate, and mechanical properties of the system are reduced to see (Table 3, alloy LSV 5 compared to alloys LSV 1, 3). At the Re contents higher than 3%, the type of α-phase changes from a Cr phase to a mixed Cr-Re phase (with 15–20 at. % of Re and up to 8 at. % of Co, Table 4,5). The new phase has much finer morphology (size is 1 μm and smaller) and its presence prevents also precipitation of needle-like Re-rich r- and p-phases, since the solubility range of Re and Co in the α-Cr-Re phase is relatively wide. The condition, where the desirable Cr-Re α-phase precipitates is described (for Al range 6.5–7.2% and in presence of Ta, Nb, Si; W+Mo=0; Re>3%) as $$(Re+0.2Co)/0.5Cr=0.9, \quad \{1\}$$

where Re, Co, Cr are the contents of elements in the alloy in wt. %. At (Re+0.2 Co)/0.5 Cr<0.9 the coarse α-Cr and needle-like Re-rich TCP phases precipitate.

Typically, MCrAlY coatings contain 0.3 to 1 wt % Y which has a powerful effect on the oxidation resistance of the alloy. In some fashion, Y acts to improve the adherence of the oxide scale which forms on the coating, thereby substantially reducing spallation. A variety of other so-called oxygen active elements (La, Ce, Zr, Hf, Si) have been proposed to replace or supplement the Y content. Patents which relate to the concept of oxygen active elements in overlay coatings include U.S. Pat. Nos. 4,419,416 and 4,086,391. In the present invention Y is added in amounts on the order of 0.3 to 1.3 wt %, La and elements from the Lanthanide series in amounts ranging from 0 to 0.5 wt %. In the present invention Nb and Ta were found to increase oxidation resistance through reducing the rate of oxide growth, with their cumulative effect stronger than the influence of any one of them taken separately. Even small amounts of Nb on the order of 0.2–0.5 wt % in the presence of Ta has found to have a significant effect on oxidation resistance (preferred composition results vs. LSV-7, Table 3).

Si in the alloy increases oxidation resistance by increasing the activity of Al (FIG. 4). The Si effect on Al activity becomes significant first at a Si content higher than 1%. At the same time, the Si content higher than 2.5% results in precipitation of brittle Ni (Ta, Si) Heusler phases and in embrittlement of a γ-matrix.

The range of composition for Hf, Y, Mg, Zr, La, C and B is optimized for oxidation lifetime of the coating.

The invention is of course not restricted to the exemplary embodiment shown and described.

TABLE 1

| Composition of experimental coatings | | | | | | | | | | |
|---|---|---|---|---|---|---|---|---|---|---|
| Coating | Ni | Co | Cr | Al | Y | Hf | Re | Si | Ta | Nb |
| LSV-1 | bal | 12 | 12.5 | 7 | 0.3 | — | 3.5 | 1.2 | 1.5 | 0.3 |
| LSV-3 | bal | 12 | 15 | 7 | 0.3 | 0.3 | 4.5 | 2.1 | 3 | 0.5 |
| LSV-4* | bal | 10 | 11 | 7 | 0.3 | 0.3 | 3.2 | 2.1 | 3 | 0.5 |
| LSV-5 | bal | 12 | 13 | 7 | 0.3 | 0.3 | 2.8 | 2.1 | 3 | 0.5 |
| LSV-6 | bal | 12 | 15 | 7.7 | 0.3 | 0.3 | 4.5 | 2.1 | 3 | 0.5 |
| LSV-7 | bal | 12 | 13 | 7 | 0.3 | 0.3 | 3.5 | 1.2 | 2.1 | — |
| LSV-9 | bal | 12 | 20 | 6.7 | 0.5 | 0.3 | 3.5 | 1.2 | 3 | 0.5 |
| LSV-10 | bal | 12 | 12.5 | 6.1 | 0.3 | — | 3.5 | 1.2 | 1.5 | 0.3 |
| LSV-11 | bal | 12 | 8.5 | 7 | 0.5 | 0.5 | 3.0 | 2 | 3 | 0.3 |

LSV-4*: W = 2.5 wt. %, Mo = 1 wt. %

TABLE 2

| Preferred range of the alloy according to the invention | | | | | | | | | |
|---|---|---|---|---|---|---|---|---|---|
| Coating | Ni | Co | Cr | Al | Hf | Re | Si | Ta | Nb |
| SV16 | bal | 11–16 | 12.5–15.5 | 6.5–7.2 | 0.2–1.2 | 3.2–5 | 1–2.5 | 1.5–4.5 | 0.2–2 |
| Coating | Y | Mg | Zr | La* | C | B | Y + Zr + La* | (Re + 0.2Co)/0.5Cr | |
| SV16 | 0.2–1.2 | 0–1.5 | 0–1.5 | 0–0.5 | 0–0.15 | 0–0.1 | 0.3–2.0 | 0.9–1.2 | |

La* = La and La-series elements

TABLE 3

| Experimental evaluation of coatings | | |
|---|---|---|
| Coating | Oxidation resistance at 1000° C. Weight gain after 1000 h of isothermal oxidation test, mg/cm$^2$ | Ductility after ageing at 900° C. Elongation of coated tensile specimen (CMSX-4) at the moment of coating failure, RT/400° C.; %; |
| LSV-1 | 1.0 | >10/>10 |
| LSV-3 | 0.8 | >10/>10 |
| LSV-4 | 5.8 | >10/>10 |
| LSV-5 | 3.0 | 3.2/7.0 |
| LSV-6 | 0.8 | 2.3/3.6 |
| LSV-7 | 3.9 | >10/>10 |
| LSV-9 | 1.0 | 2.5/5.0 |
| LSV-10 | 4.5 | >10/>10 |
| LSV-11 | 7.2 | >10/>10 |

TABLE 4

| Phase volume fraction in structure of experimental coatings, vol. % | | | | | | |
|---|---|---|---|---|---|---|
| Coating | γ | γ' | β | σ,r | α-Cr,Re | α-Cr |
| LSV-1 | 36 | 62 | | | 2 | |
| LSV-5 | 19 | 70 | | 6 | | 5 |
| LSV-6 | 36 | 41 | 18 | 5 | | |
| LSV-9 | 27 | 55 | 4 | | | 14 |

TABLE 5

| Phase composition of α phase in experimental coatings, at. % | | | | | | |
|---|---|---|---|---|---|---|
| Coating | Phase | Ni | Co | Cr | Re | Si |
| LSV-5 | α-Cr | 2 | 2 | 91 | 3 | 2 |
| LSV-1 | α-Cr,Re | 1 | 5 | 75 | 18 | 1 |

What is claimed is:

1. A nickel base alloy, comprising: (measured in % by weight):

Co 11–16;

Cr 12.2–15.5;

Al 6.5–7.2;

Re 3.2–5.0;

Si 1.0–2.5;

Ta 1.5–4.5;

Nb 0.2–2.0;

Hf 0.2–1.2;

Y 0.2–1.2;

Mg 0–1.5;

Zr 0–1.5;

La and La-series elements 0–0.5;

C 0–0.15;

B 0–0.1; and a remainder including Ni with impurities wherein (Re+0.2 Co)/0.5 Cr is not less than 0.9 and Y+Zr+ (La+La-series) ranges from 0.3–2.0.

2. A nickel base alloy as claimed in claim 1, having a phase structure consisting of fine precipitates of γ' and α-Cr in a γ-matrix.

3. A coating comprised of the nickel base alloy as claimed in claim 1, having a phase structure consisting of fine precipitates of γ' and α-Cr in a γ-matrix.

4. A coating as claimed in claim 3, wherein the fine precipitates of γ' ranges from 55 to 65 vol. % and the α-Cr ranges from 1.5 to 3 vol. % in the γ-matrix.

5. A nickel base alloy as claimed in claim 1, comprising a coating for gas turbine components.

6. A nickel base alloy as claimed in claim 1, comprising a coating for gas turbine blades and vanes.

7. A nickel base alloy as claimed in claim 1, consisting essentially of measured in % by weight Co 11–16;

Cr 12.2–15.5;

Al 6.5–7.2;

Re 3.2–5.0;

Si 1.0–2.5;

Ta 1.5–4.5;

Nb 0.2–2.0;

Hf 0.2–1.2;

Y 0.2–1.2;

Mg 0–1.5;

Zr 0–1.5;

La and La-series elements 0–0.5;

C 0–0.15;

B 0–0.1; and a remainder including Ni with impurities wherein (Re+0.2 Co)/0.5 Cr is not less than 0.9 and Y+Zr+ (La+La-series) ranges from 0.3–2.0.

8. A nickel base alloy as claimed in claim 1, comprising a thermally sprayed coating on a turbine blade or turbine vane.

9. A nickel base alloy as claimed in claim 1, wherein Cr and Re form a mixed α-Cr-Re phase with 15 to 20 atomic % Re and up to 8% Co, the mixed αCr-Re phase having a size of 1 μm and smaller.

10. A nickel base alloy as claimed in claim 1, wherein the alloy is W-free.

11. A nickel base alloy as claimed in claim 1, wherein the Nb content is 0.2 to 0.5%.

12. A nickel base alloy as claimed in claim 1, wherein the alloy is Mo-free.

* * * * *

UNITED STATES PATENT AND TRADEMARK OFFICE

CERTIFICATE OF CORRECTION

PATENT NO. : 6,383,312 B1
DATED : May 7, 2002
INVENTOR(S) : Maxim Konter et al.

It is certified that error appears in the above-identified patent and that said Letters Patent is hereby corrected as shown below:

Title page,
Item [73], Assignee, please delete "Alstom Ltd", and add -- ALSTOM (Switzerland) Ltd --.

Signed and Sealed this

Fifteenth Day of October, 2002

*Attest:*

*Attesting Officer*

JAMES E. ROGAN
*Director of the United States Patent and Trademark Office*